United States Patent [19]

Steingroever

[11] 4,021,763

[45] May 3, 1977

[54] APPARATUS AND PROCESS FOR MULTIPOLAR MAGNETIZATION OF MAGNETIC INFORMATION STORAGE SHEETS

[75] Inventor: Erich Steingroever, Bonn, Germany

[73] Assignee: Elektro-Physik, Hans Nix & Dr. -Ing. E. Steingroever KG, Cologne, Germany

[22] Filed: June 10, 1975

[21] Appl. No.: 585,567

[30] Foreign Application Priority Data

June 12, 1974 Germany ..... 2428282

[52] U.S. Cl. ..... 335/284; 335/303

[51] Int. Cl.[2] ..... H01F 13/00

[58] Field of Search ..... 335/284, 303, 205, 206, 335/207

[56] References Cited

UNITED STATES PATENTS

| | | | |
|---|---|---|---|
| 2,722,617 | 11/1955 | Clumen et al. | 335/284 X |
| 2,722,636 | 11/1955 | Minchom | 335/284 |
| 2,764,716 | 9/1956 | Minchom | 335/284 |
| 3,139,567 | 6/1964 | Atkinson | 335/284 |

*Primary Examiner*—George Harris
*Attorney, Agent, or Firm*—George H. Mitchell, Jr.

[57] ABSTRACT

Apparatus for magnetizing selected areas of data storage plates, sheets or discs of the type wherein the stored data is represented by the location and arrangement of these magnetized areas, consists of a series of pole pieces which can be shifted into contact with the selected areas and simultaneously excited by a magnetic field. The process is also claimed.

15 Claims, 6 Drawing Figures

FIG. 1
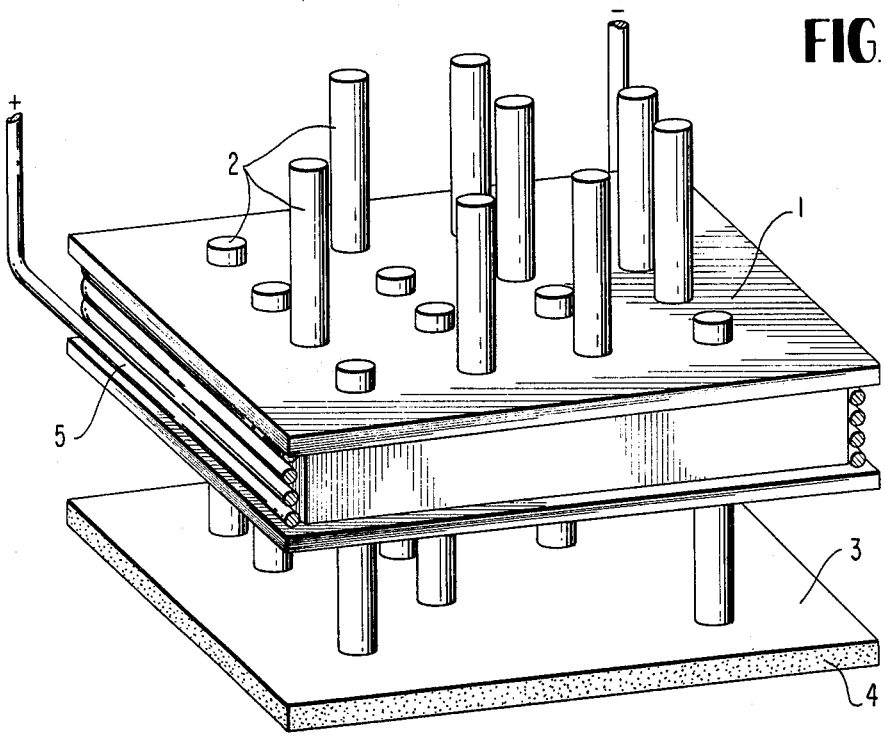
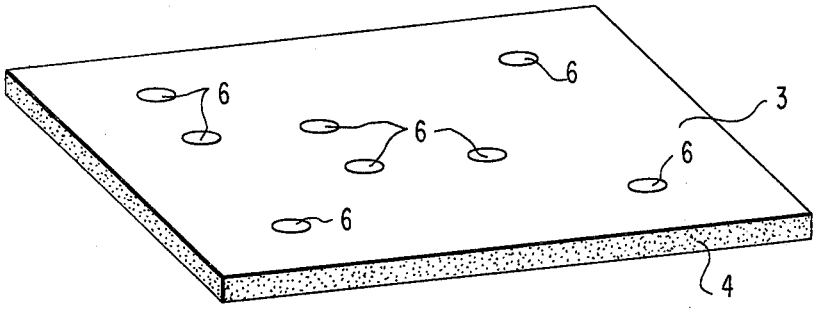
FIG. 2

APPARATUS AND PROCESS FOR MULTIPOLAR MAGNETIZATION OF MAGNETIC INFORMATION STORAGE SHEETS

The present invention relates to apparatus and a process for the multi-polar magnetization of permanent magnet materials in sheet, or plate-like form such as those used for the purpose of storing data.

It is already known to produce a plurality of magnetic poles in a plate or sheet-like permanent magnetic material such as permanent magnetic discs composed of rigid or flexible material, for the purpose of storing data. In this case, the data is represented by the arrangement of the magnetic poles on the surface of the permanent magnet material.

It is also known to store data on the surface of a sheet or plate by inserting previously magnetized permanent magnets at various points in the surface of the plate or sheet. This system has been employed, for example, in the making of magnetic keys by inserting small cylindrical permanent magnets in the flat shank of the key in a specific arrangement which corresponds to the arrangement of the sensors in the locking mechanism of the associated locks so that when the key having the appropriate arrangement of magnets is inserted, the mechanism releases the lock.

An object of the present invention is to provide a magnetizing apparatus which can be easily adjusted for imparting any desired configuration of magnetic poles to a sheet or plate of permanent magnet material or, in the case where small permanent magnets have been inserted in the surface of a material which is not necessarily magnetic selected ones of the permanent magnet may be magnetized corresponding to the information to be stored. A further object is to provide a process for accomplishing the aforementioned results.

The apparatus according to the invention for producing multiple poles in sheet-like permanent magnets or in permanent magnets disposed in a surface, comprises a support which preferably comprises a block of ferromagnetic material having a series of bore holes extending through it for the individual pole pieces. The pole support is adapted to be magnetically excited by means of an electric winding which surrounds it. The apparatus is further characterized by the use of ferromagnetic pole pieces such as iron rods which are slidably supported in the bore holes of the pole support whereby selected ones of the pole pieces can be brought into contact with the surface of the data storage sheet which is to be magnetized.

The process according to the invention is characterized by the fact that the pole pieces which form the desired information pattern are pushed out from the pole support until they contact the surface of the permanent magnet sheet or the individual magnets embedded in a sheet, while the remaining pole pieces remain in their retracted positions and do not touch the surface of the sheet to be magnetized during the time when the pole support itself is energized by a magnetizing pulse.

In the drawings

FIG. 1 is a perspective view of a simplified embodiment of a preferred form of apparatus constructed in accordance with the present invention;

FIG. 2 is a perspective view of a permanent magnet data storage sheet of the type with which the present apparatus and process is to be used;

Figure 3:
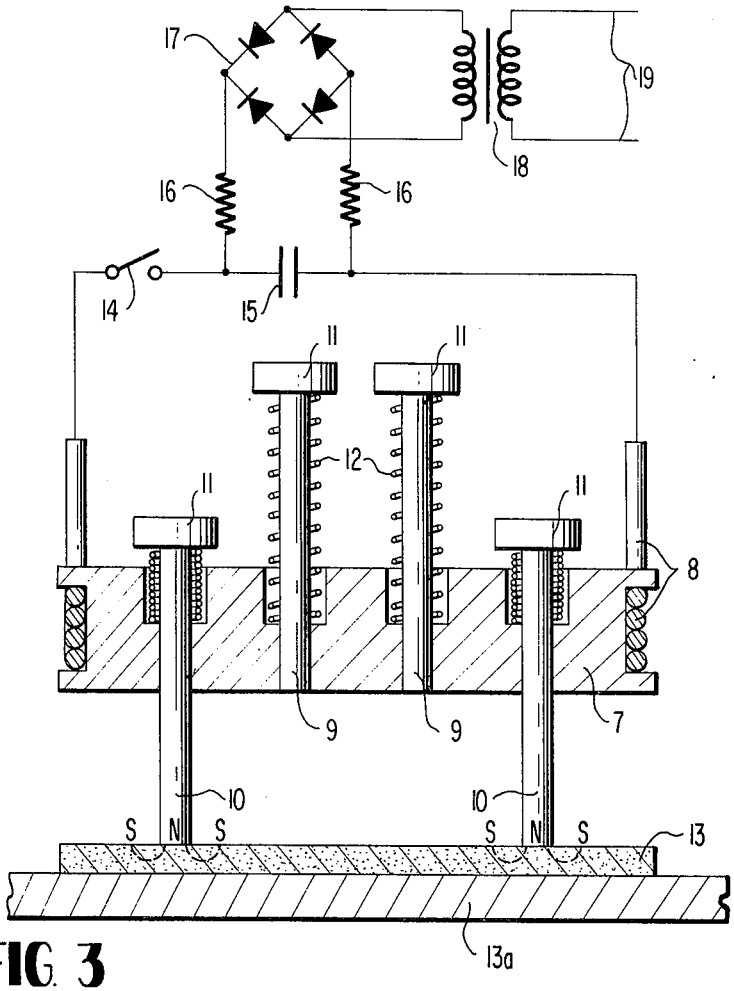
FIG. 3 is a cross-sectional elevation of a modified form of the apparatus shown in FIG. 1.

An embodiment of the apparatus according to the invention is represented in FIG. 1. It comprises a soft iron pole support 1 which is 16 mm in thickness and in which iron pole pieces 2 to 4 mm in diameter and spaced apart from each other by 8 mm are displaceably disposed. The pole pieces 2 can be pushed out from the support 1 until they contact the surface 3 of the permanent magnetic plate or disc 4. The pole support 1 is surrounded by a coil 5 consisting of 10 turns of a copper wire having a cross-section of 1.5 $mm^2$ and via which a current pulse can be delivered, for example from a capacitor.

The permanent magnetic plate or disc 4 represented individually in FIG. 2 may be made of flexible mateial. It may consist of barium-strontium-ferrite powder and plastic binder and may have a thickness of 1–2 mm, a remanence $B_r$ of 1500 gauss and a coercivity of 1150 oersted or more. The number of poles 6 produced in the plate or disc 4 corresponds to the number of pole pieces which touch the plate or disc. The magnetic flux density at these poles is about 300 gauss whereas the flux density on the surface 3 between the poles is less than 30 gauss. This flux density ratio is adequate to obtain the response of a reading device corresponding to the pole grid, consisting by example of an arrangement of Hall effect probes or of reed contacts.

FIG. 3 is a sectional view of the magnetizing apparatus according to the invention. In this FIG. 7 represents the pole support with the electric coil 8, 9 and 10 represent the displaceable pole pins in the retracted state 9 and in the extended state 10. The pole pieces 9 and 10 are provided with buttons 11 and are adapted to be moved against the force of the springs 12. The extended pole pieces touch the plate or disc 13 to be magnetized. The coil 8 is connected through the switch 14 to the capacitor 15 which is charged from the alternating current network 19 through the resistances 16, the rectifier 17 and the transformer 18. During the discharging of the capacitor through the coil 8 the extended pole pieces 10 produce the poles designated by N on the permanent magnetic plate or disc 13. A magnetic flux, which is represented by the dotted lines, forms in the vicinity of the N poles, the substantially weaker poles S having reversed polarity.

Figure 4:
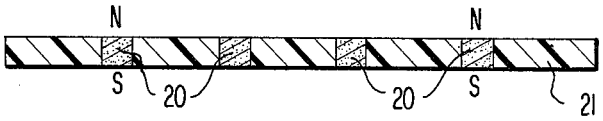
FIG. 4 is a cross-sectional elevation of a data storage sheet of the type in which small permanent magnets are embedded in the surface.

With the magnetizing apparatus according to the invention it is also possible to produce poles in permanent magnets 20 which are inserted in a non-magnetic plate 21, for example, a plastic plate, as represented in FIG. 4.

Figure 5:
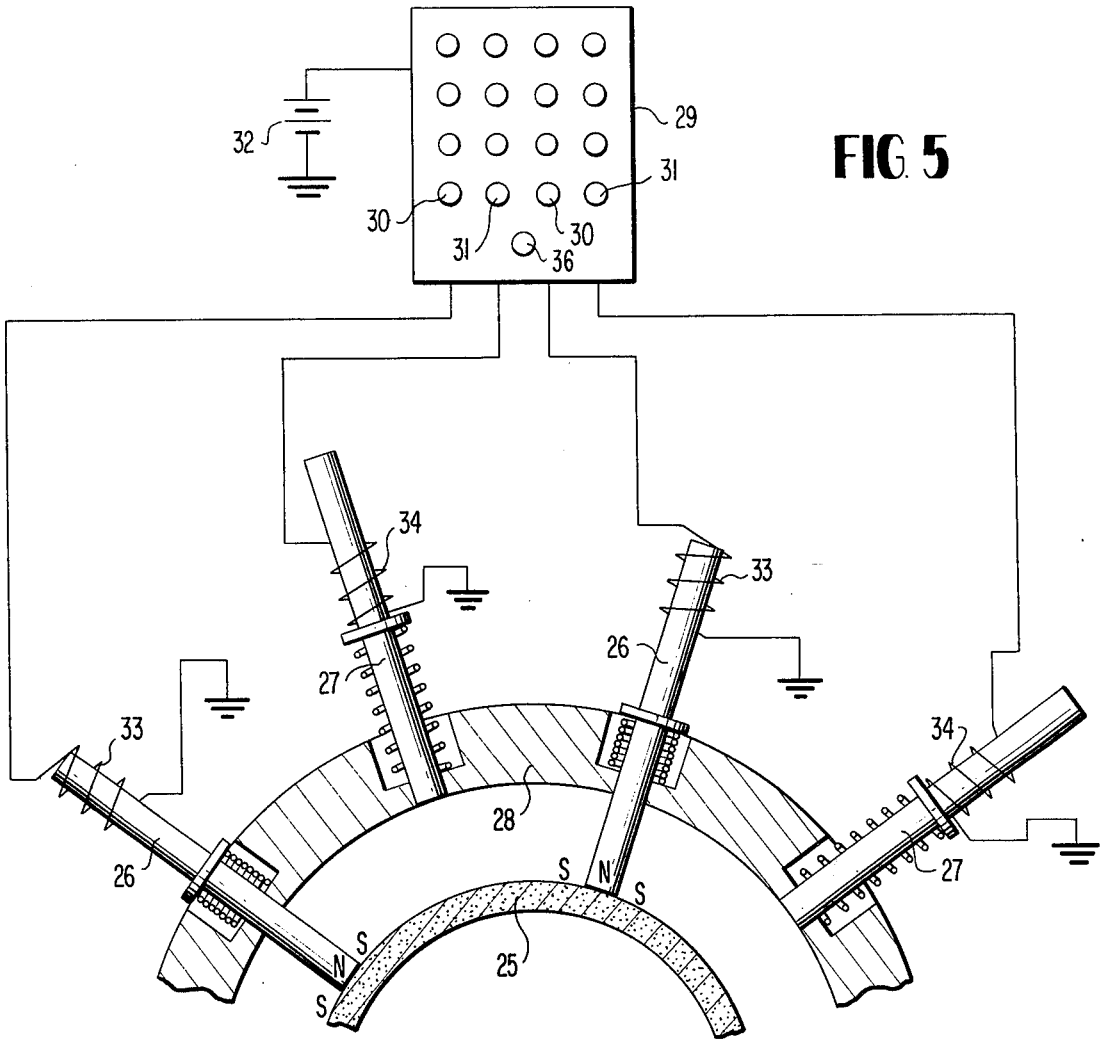
FIG. 5 is a cross-section of another modified form of apparatus for use with curved data storage sheets and being capable of remote operation.
Figure 6:
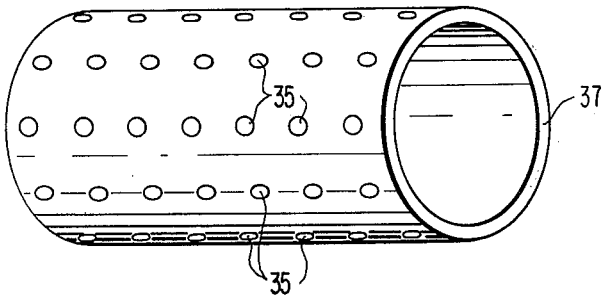
FIG. 6 is a perspective view of a cylindrical data storage sheet.

The surface of the plate or disc can be both flat, as represented in the drawings, and also curved, for example, cylindrical, as in FIGS. 5 and 6.

According to the invention the displaceable pole pieces can be connected to a manually or electrically operable keyboard which is used to feed in the data to be stored.

During the magnetizing process a ferromagnetic plate, for example, a soft iron plate 13*a* is advantageously inserted beneath the plate or disc 13 to be magnetized.

The pole pieces may have a circular cross-section as represented in the drawings. According to the invention they may also possess different cross-sections, for example, rectangular, sector-shaped or triangular in cross-section. As a result, the poles produced in the permanent magnets have a corresponding form.

The pole support can consist of ferromagnetic material, for example, soft iron. Advantageously, it consists of an iron alloy having a low electrical conductivity, thereby avoiding eddy currents during magnetization. The pole support can also be made of a non-magnetic material such as brass or plastic.

In the modification shown in FIG. 5 a form of apparatus is shown for producing a series of magnetic poles in the surface of a curved data storage plate, indicated by numeral 25, which, in this case, forms a portion of a cylinder. In this case the displaceable pole pieces 26 and 27 are slidably mounted in a series of bores extending through a ferromagnetic support 28, which is curved to correspond with the curvature of the storage device 25 to enable the ends of the pole pieces 26 and 27 to engage with the plate 25 at right angles thereto. However, in this case the pole pieces can be controlled from a remote location, such as by means of a keyboard, indicated by numeral 29 provided with a series of keys which are arranged to correspond with the position of the areas which are to be magnetized on the data sheets or plates; for example, the keys 30 correspond to the areas which may be magnetized by the pole pieces 26, while the keys 31 correspond to the areas affected by the pole pieces 27. Each of the keys is arranged to actuate a switch (not shown) which may close a circuit which includes a source of electrical energy, such as the battery 32 and a device for displacing one of the pole pieces. As one example of such a device each of the pole pieces may be surrounded near its outer end by a solenoid coil as indicated by numeral 33 in the case of pole pieces 26 and numeral 34 in the case of pole pieces 27. Thus, when a key is depressed such as the keys 30, the solenoids 33 will be energized to project the pole pieces 26 into contact with data storage device 25. A conventional holding circuit (not shown) can also be included for each key to maintain the solenoid energized for as long as is necessary to project all the pole pieces necessary for a particular pattern of information storage. After the ferromagnetic support 28 has been magnetically excited, in the same manner as in the previous embodiment, to produce the desired arrangement of magnetic poles, the pole pieces can all be retracted by opening the energizing circuit for the solenoids, as by means of a reset key 36.

A cylindrical data storage device is shown in FIG. 6, in which the cylindrical body 37 may consist of a non-magnetic material, such as plastic, into which a plurality of buttons 35, of permanent magnet material have been embedded.

I claim:

1. Apparatus for magnetization of data, storage plates, sheets or discs, of the type wherein information is represented by the magnetization of selected areas thereof, comprising a plurality of ferromagnetic pole pieces corresponding to the locations of said selected areas of the plates, sheets or discs which may be magnetized, means supporting each of said pole pieces for displaceable movement between a first position in contact with the surface of a respective one of said areas for magnetization of certain of said areas only, and a second position spaced away from said area, and means for subjecting all of said pole pieces to a magnetic field sufficient to permanently magnetize only the areas in contact with the pole pieces positioned in said first position and to avoid magnetization of the areas corresponding to the pole pieces in said second position.

2. The invention defined in claim 1 wherein said support means comprises a block of ferromagnetic material, and said pole pieces are slidably received in bores provided in said block.

3. The invention defined in claim 2 wherein said support means also includes biassing means for each of said pole pieces to urge them toward their second positions.

4. The invention defined in claim 2 wherein said means for subjecting said pole pieces to a magnetic field includes a coil surrounding said block of ferromagnetic material and circuit means including a source of direct current and capacitor means connected with said coil.

5. The invention defined in claim 2 wherein said bores are arranged to support said pole pieces for movement in parallel directions for use with flat data storage plates.

6. The invention defined in claim 2 wherein said bores are arranged to support said pole pieces for movement in angularly related directions normal to the respective areas of contact with a respective pole piece.

7. The invention defined in claim 2 wherein one end of each pole piece projects outwardly from said support means for individual manual movement between said first and second positions.

8. The invention defined in claim 7 wherein said support means includes biassing means for each of said pole pieces to urge them towards their second positions.

9. The invention defined in claim 1 wherein said apparatus also includes a ferromagnetic plate to be positioned against the opposite surface of said data storage plates, sheets or discs during magnetization.

10. The invention defined in claim 1 wherein at least that portion of a pole piece which comes into contact with said data plates, sheets or discs is provided with a cross-section corresponding to the configuration of the area to be magnetized by that pole piece.

11. The invention defined in claim 1 wherein said support means for the pole pieces is composed of soft iron.

12. The invention defined in claim 1 wherein said apparatus includes remote means for controlling the movement of said pole pieces.

13. The invention defined in claim 12 wherein said remote means comprises electrically actuated means for moving each of said pole pieces, and circuit means including keyboard means connected with said electrically actuated means.

14. Process for the production of magnetic information storing devices of the type wherein localized areas of a sheet are permanently magnetized in a predetermined pattern which is representative of the data stored in said sheet, comprising the steps of:

a. arranging a plurality of ferromagnetic pole pieces to be displaceable between a first position wherein each of the pole pieces may contact with said sheet at a respective one of said localized areas of the sheet and a second position spaced away from said sheet;

b. arranging the pole pieces of said plurality which correspond to selected areas representative of data to be stored on a sheet in their respective first positions;

c. placing the remainder of the pole pieces of said plurality in their respective second positions;

d. placing the respective areas of a sheet in contact with the pole pieces which have been placed in their first positions;

e. subjecting all of said pole pieces simultaneously to a magnetic field sufficient to magnetize the selected areas of said sheet.

15. Process of claim 14 which includes the steps of:

f. rearranging the pole pieces of said plurality which correspond to selected areas representative of data to be stored on a second sheet in their respective first positions;

g. placing the remainder of the pole pieces of said plurality in their respective second positions;

i. subjecting all of said pole pieces to a magnetic field sufficient to magnetize the selected areas of said second sheet.

* * * * *